US006093060A

United States Patent [19]

Wiebking et al.

[11] Patent Number: 6,093,060

[45] Date of Patent: Jul. 25, 2000

[54] ELECTRICAL CONNECTOR ASSEMBLED WITH A TERMINAL ARRAY THAT IS CONNECTED BY A CARRIER STRIP

[75] Inventors: David Michael Wiebking, Kernersville; Scott C. Scholl; Don K. Willis, both of Winston-Salem; Victor E. Slack, Lewisville, all of N.C.

[73] Assignee: The Whitaker Corporation, Wilmington, Del.

[21] Appl. No.: 09/266,340

[22] Filed: Mar. 11, 1999

[51] Int. Cl.[7] ..... H01R 24/00

[52] U.S. Cl. ..... 439/676; 439/79; 439/701; 439/541.5

[58] Field of Search ..... 439/676, 418, 439/541.5, 540, 885, 79

[56] References Cited

U.S. PATENT DOCUMENTS

| | | | |
|---|---|---|---|
| 4,210,376 | 7/1980 | Hughes et al. | 439/670 |
| 4,734,043 | 3/1988 | Emert et al. | 439/676 |
| 4,767,338 | 8/1988 | Dennis et al. | 439/55 |
| 5,419,720 | 5/1995 | Chen | 439/676 |
| 5,531,612 | 7/1996 | Goodall et al. | 439/541.5 |
| 5,562,507 | 10/1996 | Kan | 439/676 |
| 5,702,271 | 12/1997 | Steinman | 439/676 |
| 5,709,554 | 1/1998 | Savage, Jr. | 439/541.5 |
| 5,749,752 | 5/1998 | Kashiyama et al. | 439/885 |

*Primary Examiner*—Gary F. Paumen
*Assistant Examiner*—Briggitte Hammond
*Attorney, Agent, or Firm*—Robert Kapalka

[57] ABSTRACT

An electrical connector includes a housing having a front face and a cavity which is open through the front face for receiving a mating electrical connector. The housing has a terminal support shelf and a wall which is spaced from the terminal support shelf to define a slot between the terminal support shelf and the wall. The slot extends in a longitudinal direction from an upstream end which is open through a rear of the housing to a downstream end which is open to the cavity. The slot has a laterally extending width. The housing carries terminals which extend longitudinally through the slot and which are arranged side-by-side along the width of the slot. The terminals are initially attached to a carrier strip. The terminals are inserted into the slot from the upstream end with the carrier strip leading the terminals through the slot and emerging from the downstream end of the slot, and the carrier strip is removed from the terminals after the terminals are installed in the housing.

7 Claims, 6 Drawing Sheets

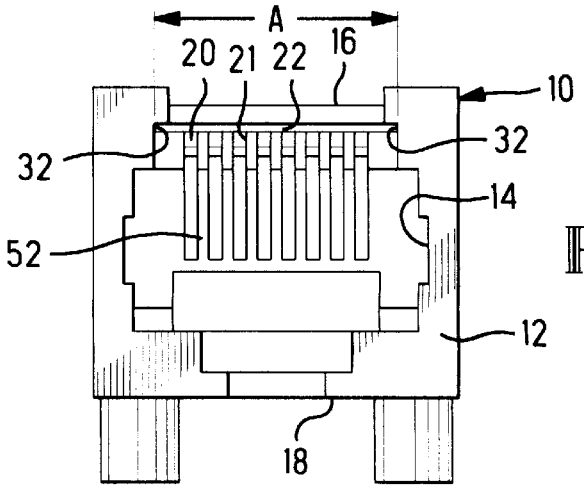
FIG. 3
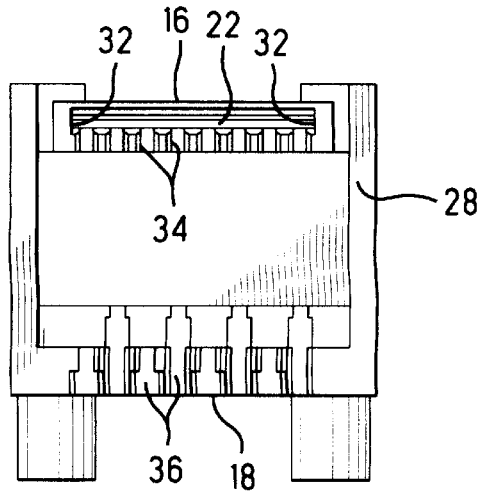
FIG. 4
FIG. 5
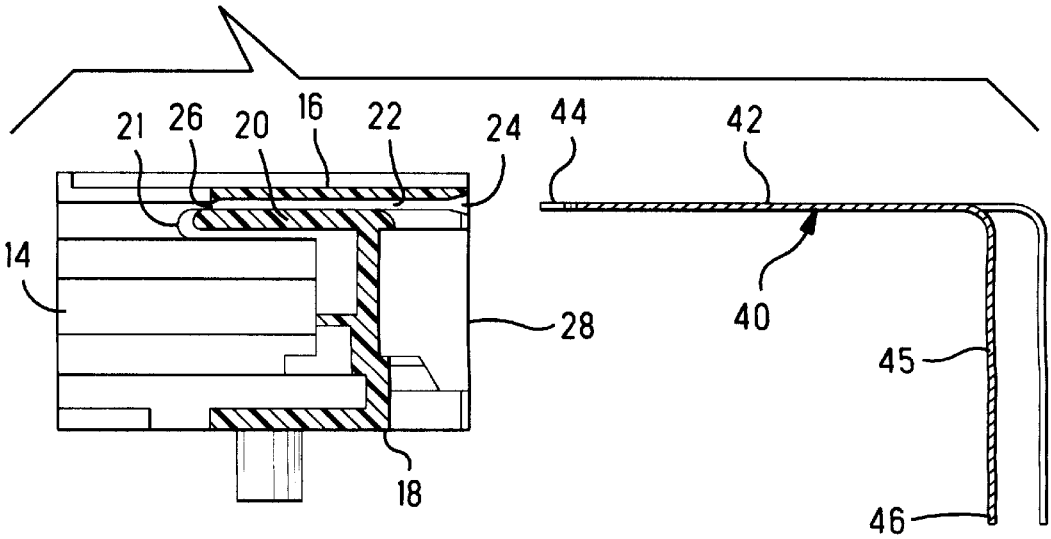

ELECTRICAL CONNECTOR ASSEMBLED WITH A TERMINAL ARRAY THAT IS CONNECTED BY A CARRIER STRIP

FIELD OF THE INVENTION

The invention relates to an electrical connector including a housing having a cavity and a plurality of terminals which are arranged in the cavity for engagement with terminals of a mating electrical connector.

BACKGROUND OF THE INVENTION

U.S. Pat. No. 5,531,612 discloses a stacked modular jack comprising a plurality of receptacle connectors which are arranged in stacked relationship in a common housing. Each of the receptacle connectors comprises a cavity in the housing and terminals in the cavity which are arranged for engagement with terminals of a mating plug connector. The terminals in each cavity are pre-formed as part of a terminal insert which is installed in the cavity as a unit. Each terminal insert comprises an array of terminals having portions which are overmolded by a dielectric material that holds the terminals in fixed relative positions. A terminal insert is installed in each of the cavities of the stacked modular jack. Manufacture of these terminal inserts requires a number of operations, thereby adding to manufacturing cost, and handling these inserts further increases the cost and complexity of the stacked modular jack.

Alternatively, it is known to stitch terminals into a connector housing without the aid of an overmolded insert. In this technique, the housing is formed with multiple apertures each of which receives a respective terminal. These apertures must be configured complementary to the configurations of the terminals which are held therein. If it becomes necessary to change the configuration of the terminals, a problem occurs in that the configuration of the apertures must also be changed, thereby requiring a change to mold tooling for the housing. Further, although the stitching technique avoids the expense of overmolding the terminal array, it is more difficult to handle and manipulate a plurality of individual terminals which are not overmolded.

There is a need for an electrical receptacle connector which facilitates the insertion of terminals into the connector, which lends itself to changes in the configuration of the terminals, which minimizes the number of independent parts that must be handled during manufacture, and which is relatively inexpensive to produce.

SUMMARY OF THE INVENTION

According to one aspect of the invention, an electrical connector comprises a dielectric housing having a front face and a cavity which is open through the front face. The cavity is configured to receive a mating electrical connector along an insertion axis. The housing has a terminal support shelf and a wall which is spaced from the terminal support shelf to define a slot between the terminal support shelf and the wall. The slot extends in a longitudinal direction from a rear end which is open through a rear of the housing to a front end which is open to the cavity.

The slot has a laterally extending width. The housing carries terminals which extend longitudinally through the slot and which are arranged side-by-side along the width of the slot. The terminals have mating portions which are exposed within the cavity for engagement with contacts of the mating electrical connector. The terminals are initially attached to a carrier strip, the terminals are inserted into the slot from the rear end with the carrier strip leading the terminals through the slot and emerging from the front end of the slot, and the carrier strip is removed from the terminals after the terminals are installed in the housing.

According to another aspect of the invention, an electrical connector assembly comprises upper and lower housings which are arranged in stacked relationship. Each of the upper and lower housings is a one-piece dielectric member having a front face and a cavity which is open through the front face, the cavity being configured to receive a mating electrical connector along an insertion axis. Each of the upper and lower housings carries terminals which have mating portions that are exposed within the cavity in each housing for engagement with contacts of the mating electrical connector. The terminals in each housing are installed as part of a terminal array which is not overmolded, wherein the electrical connector assembly comprises only two dielectric pieces.

BRIEF DESCRIPTION OF THE DRAWINGS

The invention will now be described by way of example with reference to the accompanying drawings wherein:

FIG. 3 is a front elevation view of the housing;

FIG. 4 is a rear elevation view of the housing;

FIG. 5 is a cross-sectional view showing the terminal array poised for insertion in the housing;

DETAILED DESCRIPTION OF A PREFERRED EMBODIMENT

Figure 1:
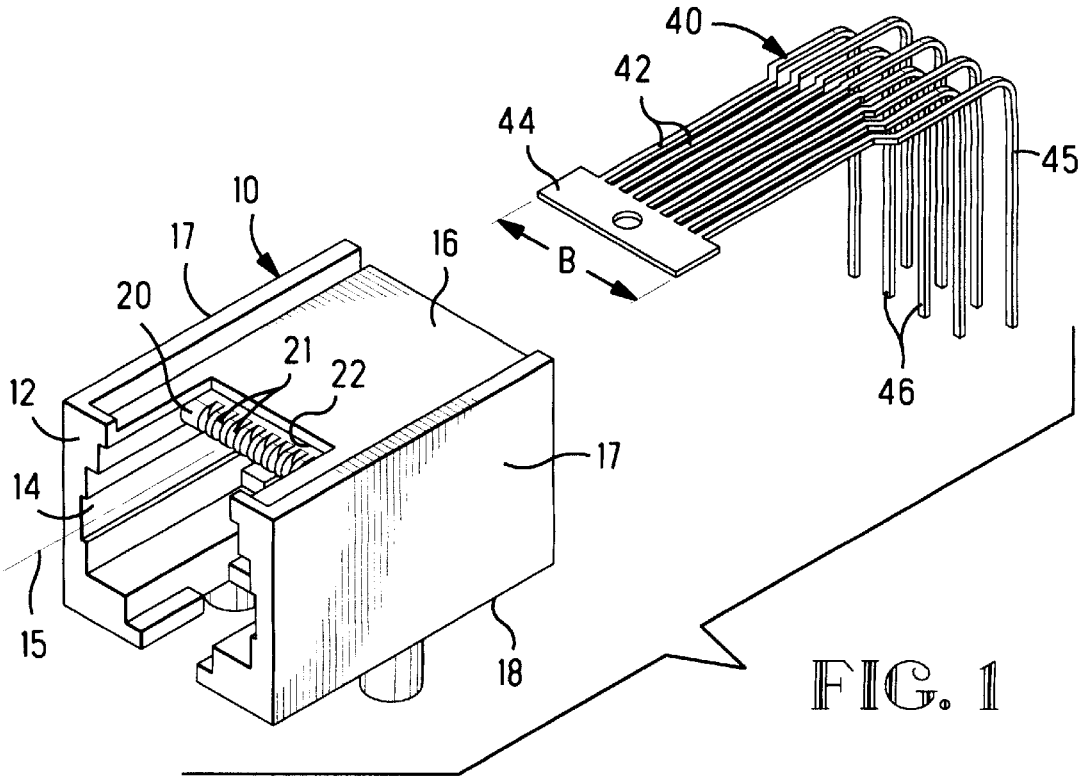
FIG. 1 is a top front isometric view of components of an electrical connector according to the invention, showing a terminal array poised for insertion in a housing.

As shown in FIGS. 1–5, an electrical connector according to the invention comprises a dielectric housing 10 having a front mating face 12 and a cavity 14 which opens into the housing through the front mating face. The cavity is configured to receive a mating electrical connector (not shown) along an insertion axis 15. The connector in the illustrated embodiment is a telecommunications-type modular jack having a cavity which can receive a mating modular plug. However, it should be understood that the invention may be embodied in various other connectors having cavities of various different configurations, all of which are considered to be within the scope of the invention.

The housing 10 is a monolithic, i.e., one-piece, unit having a top wall 16, a pair of opposite side walls 17, and a bottom wall having an exterior surface 18 which provides a circuit board mounting face. The housing also has an interior wall 20 which is spaced from and extends parallel to the top wall 16. The interior wall forms a terminal support shelf which is separated from the top wall by a slot 22. The slot extends longitudinally from a rear end 24 to a front end 26, as shown in FIG. 5. The upstream end is open to an exterior of the housing through a rear 28 of the housing, and the downstream end is open to the cavity 14 within the housing.

As shown in FIGS. 3 and 4, the slot is bounded by a pair of opposite interior surfaces 32 which extend parallel to each other, and a dimension A between the interior surfaces 32 defines a width of the slot.

Figure 2:
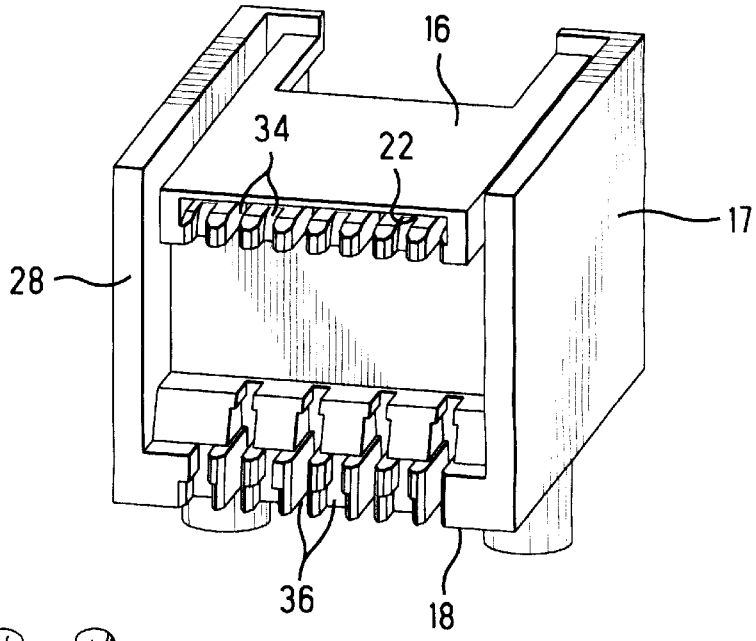
FIG. 2 is a rear isometric view of the housing.

As best seen in FIGS. 2 and 4, the rear of the housing includes an upper loom which defines an array of slots 34, and a lower loom which defines an array of slots 36. These slots 34, 36 are dimensioned to receive and capture downwardly extending portions of terminals which are installed in the housing, as will be more fully discussed.

With reference to FIGS. 1 and 5, the housing holds terminals 42 which are installed into the housing through the slot 22. The terminals are manufactured from planar sheet material which is stamped and formed to provide a terminal array 40 which includes the terminals 42 attached to a carrier strip 44. This carrier strip is one segment that has been severed from an indefinitely long carrier strip which is formed with a multitude of the terminal arrays 40.

The terminal array 40 is shown poised for insertion into the housing in FIG. 1. The carrier strip 44 holds the terminals 42 in a fixed array during handling and prior to insertion in the housing. The carrier strip 44 defines a leading end of the terminal array. The carrier strip has a width B which is only slightly less than the width A of the slot 22 in the housing. The terminals 42 extend longitudinally from the carrier strip in a side-by-side array. At a trailing end of the terminal array, the terminals 42 are bent out of a plane of the carrier strip to provide downwardly extending portions 45 which end in leads 46 that are engageable with a circuit board. These terminal leads 46 are arranged in two laterally extending, spaced-apart rows according to an industry standard footprint.

Figure 6:
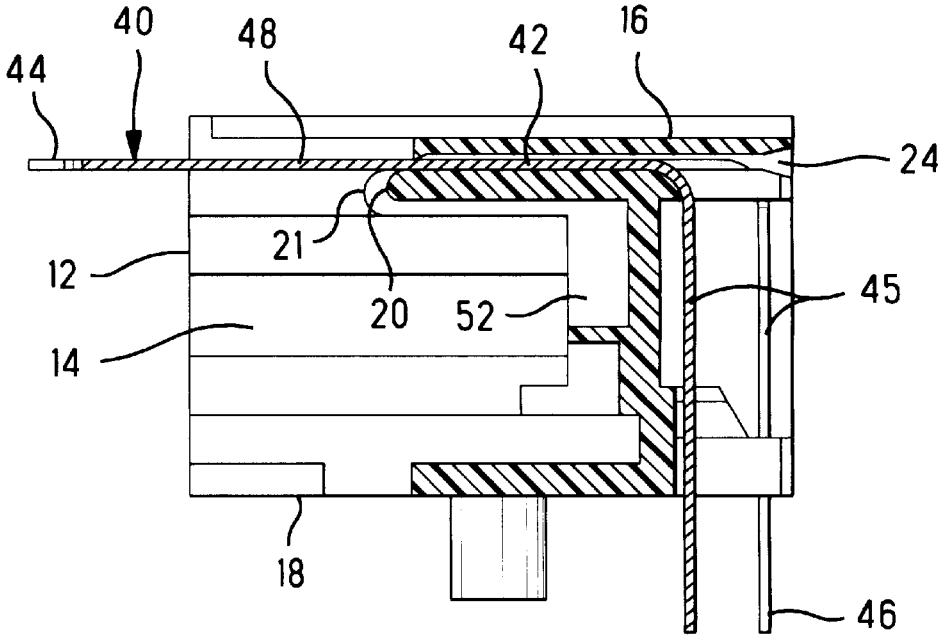
FIG. 6 is a cross-sectional view of the terminal array after installation in the housing but prior to removal of the carrier strip.
Figure 9:
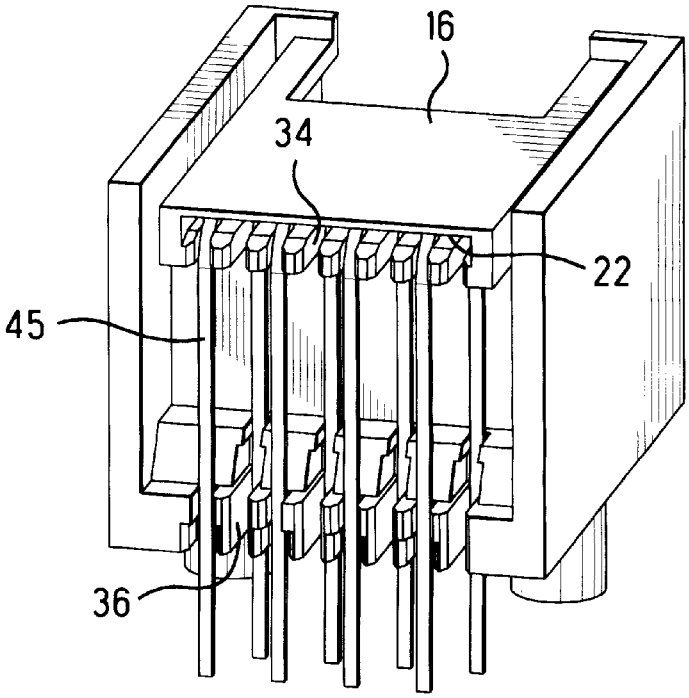
FIG. 9 is a rear isometric view of the housing and terminal array in assembled condition.

The terminal array 40 is installed into the slot 22 through the rear of the housing with the carrier strip 44 leading the terminals 42 into the slot. The carrier strip is moved fully through the slot 22 and through the cavity 14 until the carrier strip emerges beyond the front face 12 of the housing, as shown in FIG. 6. At this time, the downwardly extending portions 45 of the terminals become captured in the slots 34, 36 at the rear of the housing due to an interference fit, as shown in FIG. 9, thereby securing the terminals 42 in the housing. After this, the carrier strip 44 is severed from the terminal array, which leaves forward ends 48 of the terminals overhanging a forward end of the terminal support shelf 20.

Figure 7:
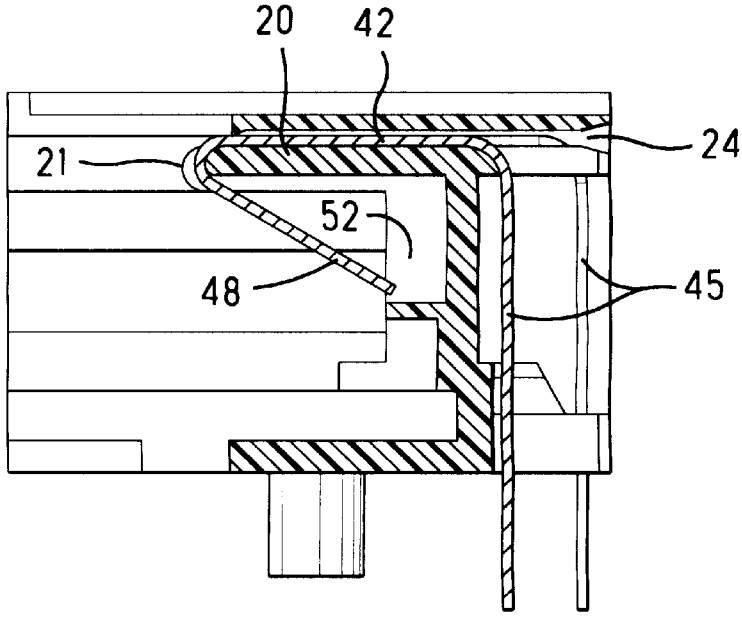
FIG. 7 is a cross-sectional view of the terminal array after removal of the carrier strip and bending of the terminals around a terminal support shelf in the housing.
Figure 8:
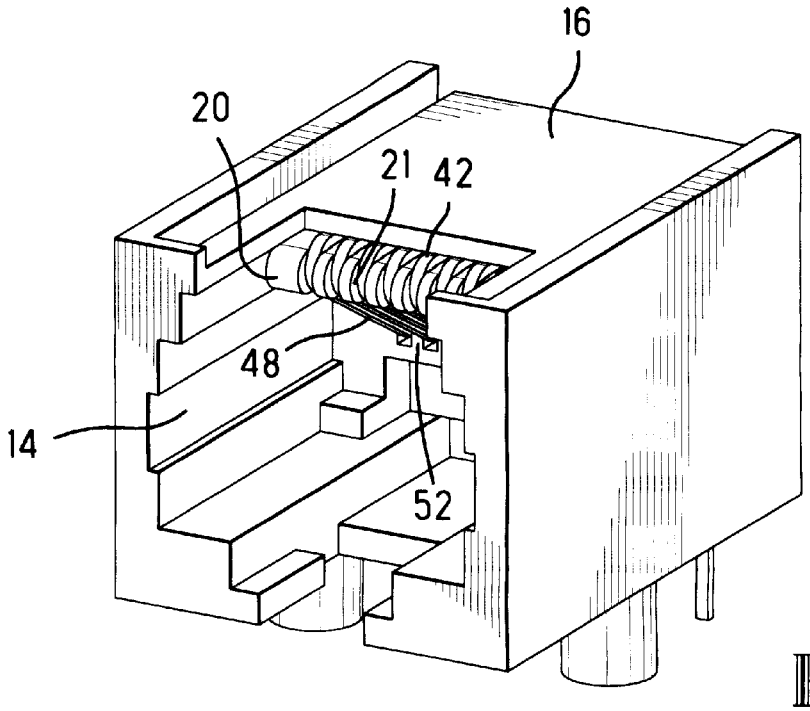
FIG. 8 is a front isometric view of the housing and terminal array in assembled condition.

The forward end of the terminal support shelf 20 as a series of ribs 21, as shown in FIGS. 1 and 6. The forward ends 48 of the terminals are bent around the forward end of the shelf, and the ribs 21 become interleaved between the terminals 42, as shown in FIGS. 7 and 8. Also at this time, forward tips of the terminals are moved into spaces between teeth 52 of a comb defined by rear wall of the cavity 14, and this comb serves to maintain the forward ends 48 of the terminals in parallel alignment. The forward ends 48 of the terminals provide resilient contact portions which are engageable with terminals of a mating plug connector that is installed in the cavity.

Figure 10:
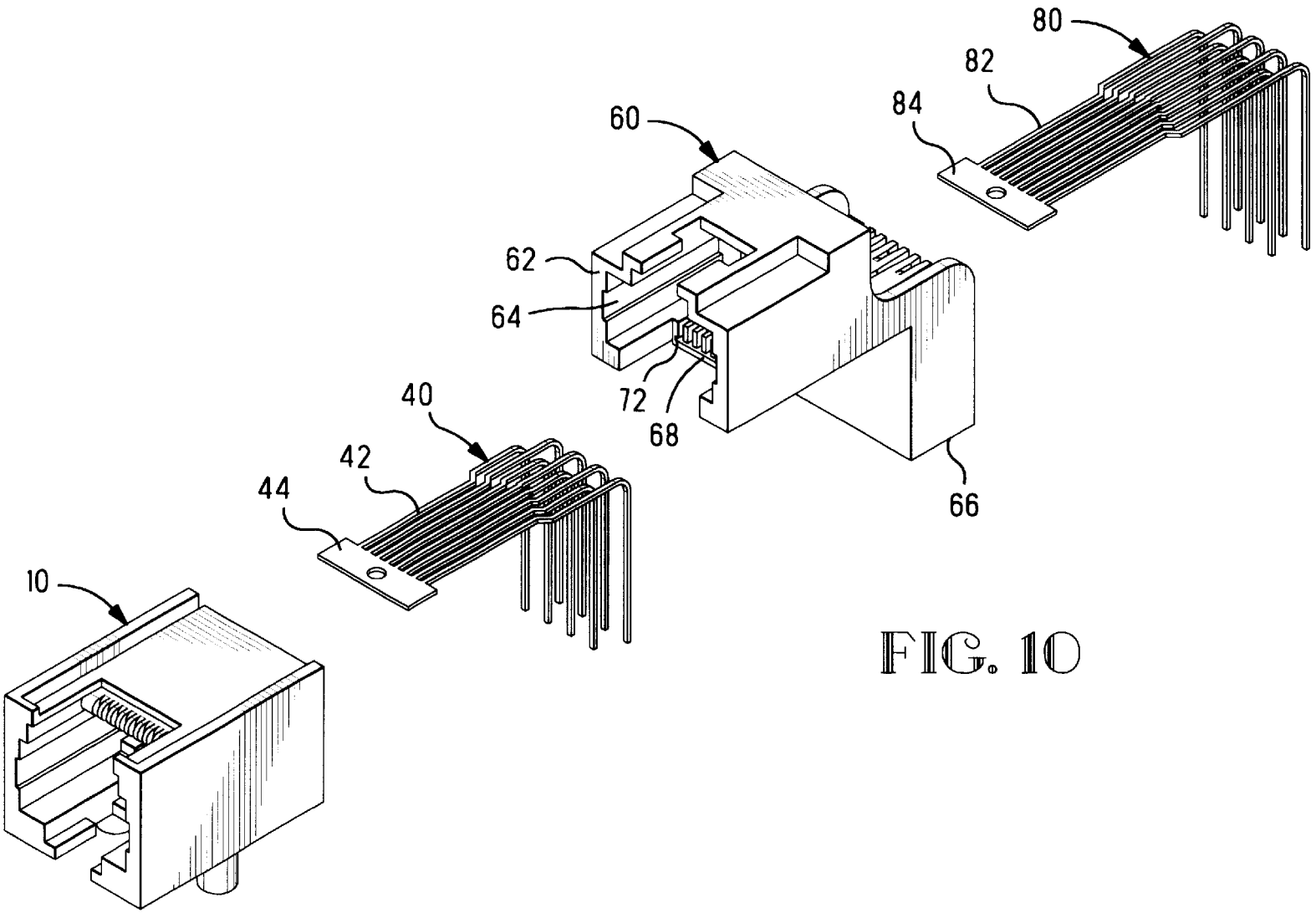
FIG. 10 is an isometric view of components prior to assembly of a stacked electrical connector according to the invention.
Figure 11:
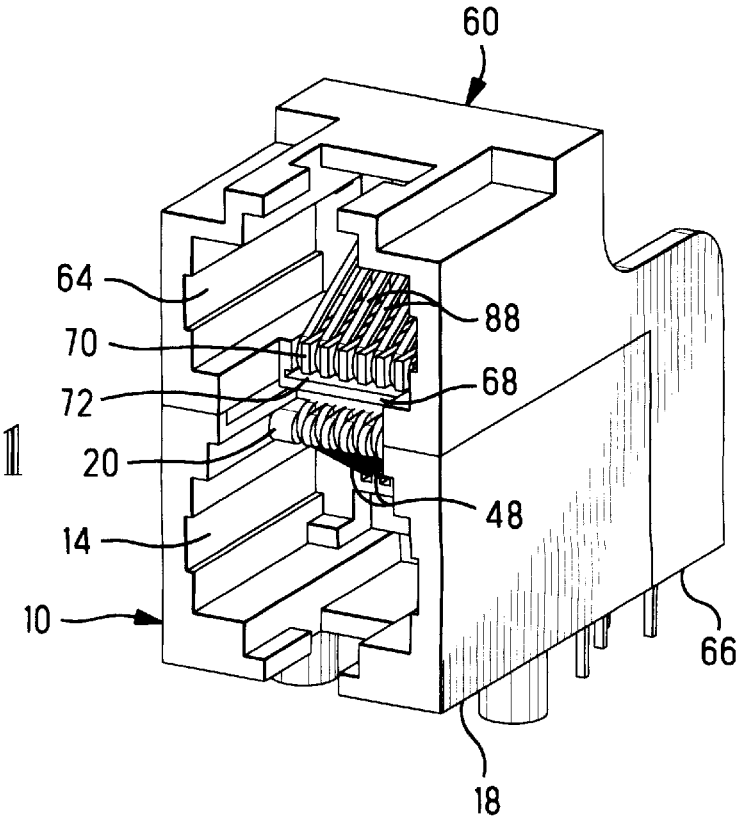
FIG. 11 is a front isometric view of the stacked electrical connector.
Figure 12:
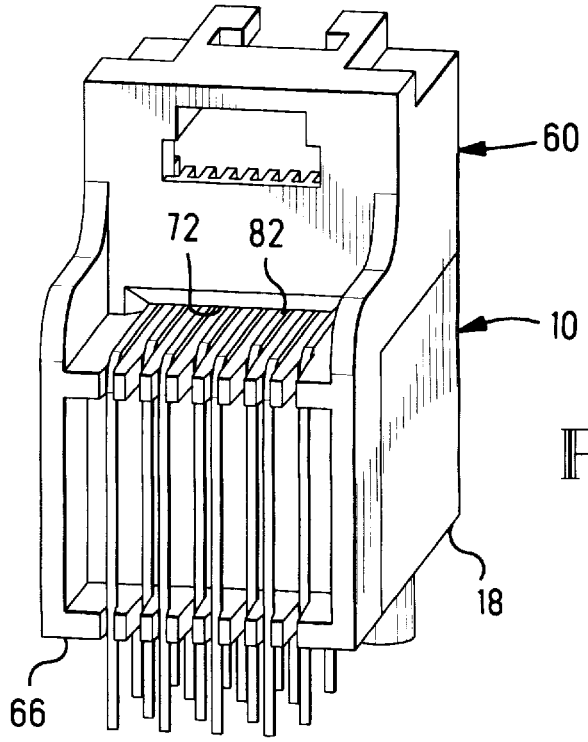
FIG. 12 is a rear isometric view of the stacked electrical connector.

With reference to FIGS. 10–12, the housing 10 may be arranged in stacked relationship with another housing 60 to provide a stacked electrical connector according to the invention. For purposes of differentiation, the housing 10 will be termed a lower housing and the housing 60 will be termed an upper housing. The upper housing 60 is configured to overhang the lower housing 10 in a complementary manner. The upper housing 60 has a front face 62, a plug-receiving cavity 64, a circuit board mounting face 66, a lower wall 68, and a shelf 70 which is spaced from the lower wall to define a terminal array receiving slot 72. The slot 72 has characteristics which are substantially identical to those of the slot 22 in the lower housing. In particular, the slot 72 has a width which is dimensioned to accommodate a carrier strip 84 at a leading end of an upper terminal array 80. The carrier strip 84 and attached terminals 82 are installed through the slot 72, and the carrier strip is severed from the terminals, in the same manner as was previously described with regard to the lower housing.

It should be noted that the cavities 14, 64 in the lower and upper housings have an inverse orientation with respect to each other when the housings are stacked together. Thus, the terminals 82 in the upper housing are bent around the shelf 70 in an opposite direction as compared with the terminals in the lower housing.

The upper and lower connector housings are secured together by any suitable means which is known to those skilled in the art.

The invention provides a number of advantages. First, a housing having a slot according to the invention permits a carrier strip at a leading end of a terminal array to be installed through the slot with terminals of the array trailing the carrier strip through the slot. The carrier strip serves to maintain the terminals in fixed relative positions until the terminals become secured in the housing, thereby eliminating the need for overmolded terminal arrays. Also, the slot can accommodate different terminal arrays having different configurations, thereby avoiding the need to have a specific housing for each configuration. Further, two housings according to the invention can be stacked, thereby providing a stacked connector assembly which utilizes only two discrete dielectric pieces. Each of the dielectric pieces is a monolithic housing which holds a respective terminal array that is not overmolded.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing having a front face and a cavity which is open through the front face, the cavity being configured to receive a mating electrical connector along an insertion axis, the housing having a wall and a terminal support shelf which is spaced from the wall to define a slot therebetween, the slot extending in a longitudinal direction from a rear end which is open through a rear of the housing to a front end which is open to the cavity, the slot having a laterally extending width;

a terminal array including terminals attached to a carrier strip, the terminals extending longitudinally from the carrier strip and being laterally spaced-apart along a width of the carrier strip that is less than the width of the slot;

wherein the terminal array is insertable into the slot from the rear end of the slot with the carrier strip leading the terminals through the slot and emerging from the front end of the slot, and the carrier strip is removable from the terminals after the terminals are installed in the housing.

2. The electrical connector of claim 1 wherein the longitudinal direction of the slot is parallel to the insertion axis.

3. The electrical connector of claim 1 wherein the terminals are configured to be bent around the terminal support shelf at the front end of the slot.

4. The electrical connector of claim 3 wherein the terminal support shelf has ribs which are arranged to be interleaved between the terminals.

5. A method of making an electrical connector comprising the steps of:

providing a dielectric housing having a front face and a cavity which is open through the front face, the cavity being configured to receive a mating electrical connector along an insertion axis, the housing having a terminal support shelf and a wall which is spaced from the terminal support shelf to define a slot between the terminal support shelf and the wall, the slot extending in a longitudinal direction from a rear end which is open through a rear of the housing to a front end which is open to the cavity, the slot having a laterally extending width;

providing a terminal array including terminals that are attached to a carrier strip and arranged side-by-side along a width of the carrier strip that is less than the width of the slot;

inserting the terminal array into the rear end of the slot with the carrier strip leading the terminals through the slot and emerging from the front end of the slot; and removing the carrier strip from the terminal array while portions of the terminals remain within the slot.

6. The method according to claim 5 further comprising the step of forming ends of the terminals to provide terminal mating portions that are exposed within the cavity for engagement with contacts of the mating electrical connector.

7. The method according to claim 6 wherein the forming comprises bending the terminals around the terminal support shelf at the front end of the slot.

* * * * *